US005762234A

United States Patent [19]

Kiel et al.

[11] Patent Number: 5,762,234

[45] Date of Patent: Jun. 9, 1998

[54] INSULATED BEVERAGE CONTAINER HOLDER ASSEMBLY

[75] Inventors: Paul F. Kiel, Springfield; Brett A. Schimanski, Rockford; Paul Burress, Bloomington, all of Ill.

[73] Assignee: Incredea Company, Springfield, Ill.

[21] Appl. No.: 707,160

[22] Filed: Sep. 3, 1996

[51] Int. Cl.[6] ..... B65D 23/00

[52] U.S. Cl. ..... 220/737; 220/903

[58] Field of Search ..... 220/737, 601, 220/739, 903

[56] References Cited

U.S. PATENT DOCUMENTS

| | | | |
|---|---|---|---|
| 3,257,025 | 6/1966 | Jolly . | |
| 3,355,046 | 11/1967 | Jolly | 220/903 X |
| 3,403,714 | 10/1968 | Hulm | 220/903 X |
| 3,434,589 | 3/1969 | Valtri et al. . | |
| 4,122,980 | 10/1978 | Laverty . | |
| 4,146,154 | 3/1979 | Mastman . | |
| 4,330,072 | 5/1982 | Mastman . | |
| 4,383,422 | 5/1983 | Gordon et al. . | |
| 4,478,265 | 10/1984 | DeMarco . | |
| 4,666,041 | 5/1987 | Gordon . | |
| 5,065,909 | 11/1991 | Pino et al. . | |
| 5,115,940 | 5/1992 | Friedman | 220/737 |
| 5,242,079 | 9/1993 | Stephens et al. . | |
| 5,447,764 | 9/1995 | Langford . | |
| 5,467,891 | 11/1995 | Perry . | |

*Primary Examiner*—Steven M. Pollard
*Attorney, Agent, or Firm*—Banner & Witcoff, Ltd.

[57] ABSTRACT

An improved insulated beverage container holder assembly is disclosed that facilitates removal of a beverage container from an insulating sleeve that is adapted to retain the beverage container in an interior cavity formed by the sleeve. The sleeve has an open top end to receive the beverage container into the interior cavity. A pressurizing means delivers air pressure into the interior cavity of the sleeve, which in turn generates forces within the interior cavity of the sleeve that operate to facilitate removal of the beverage container from the sleeve through the open top end of the sleeve.

4 Claims, 4 Drawing Sheets

FIG. 7a
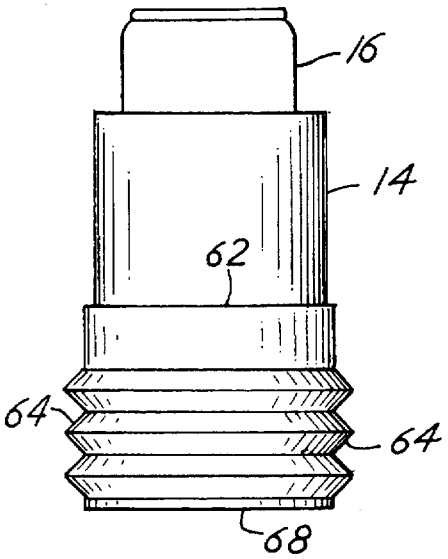
FIG. 8
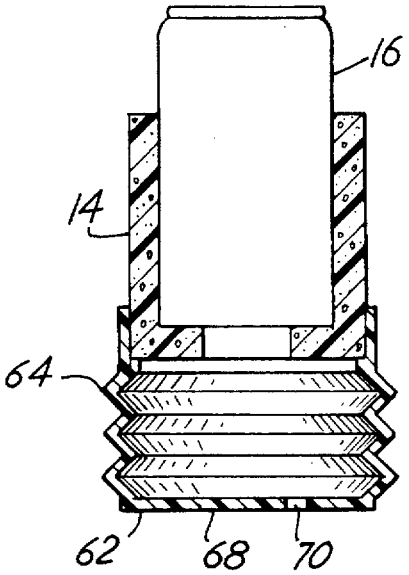
FIG. 7b
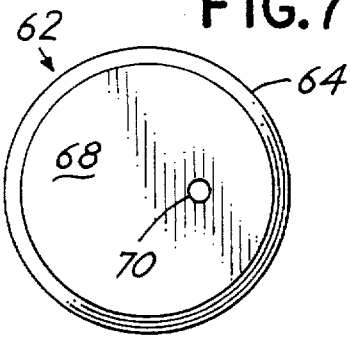
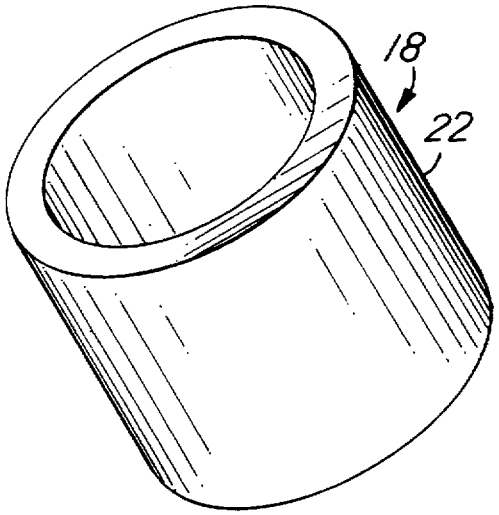
FIG. 9d
(PRIOR ART)
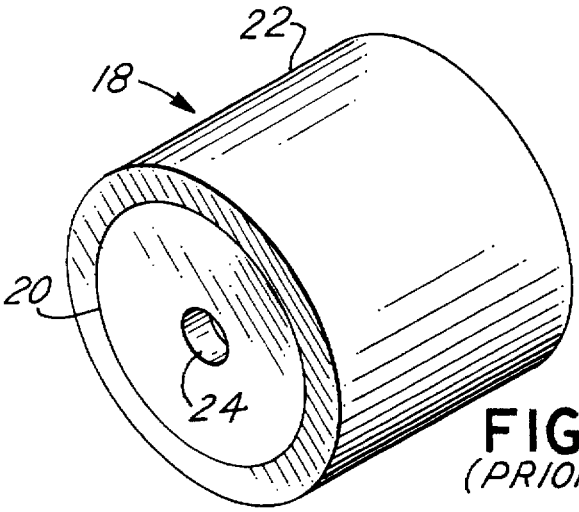
FIG. 9b
(PRIOR ART)

INSULATED BEVERAGE CONTAINER HOLDER ASSEMBLY

BACKGROUND OF THE INVENTION

The present invention relates to improved beverage container holders and, more particularly, assemblies for insulated beverage container holders that facilitate removal of the beverage container from the holder.

Elastomeric foam beverage container insulators have been widely used to provide thermal insulation for retained beverage containers, such as bottles and aluminum cans, and to provide a convenient and comfortable covering for the consumer to grasp while the consumer is enjoying the contents of the beverage container. Advertisers and others have also used the exposed outer surface of such devices as placards for conveying desired messages. While these devices have proven to be quite useful for these various purposes, it is often difficult to remove an emptied beverage container from the foam insulator. This problem has been recognized and discussed, for example, in U.S. Pat. Nos. 5,467,891 and 4,478,265.

The difficulty in removing the beverage container from the foam insulating device has been attributed to a vacuum that develops within the device upon removal of the beverage container. Moreover, it has been further reasoned that the foam insulating material tends to adhere to the beverage container, especially where the container has been retained within the insulating device for a period of time.

As a result, consumers have often found it necessary to depress the bottom surface of traditional foam insulating devices so as to push up against the bottom of the emptied beverage container, thereby forcing the container out of the top end of the insulator. This practice, however, may result in damage to structure, shape and/or insulating characteristics of the foam insulating device. An inventor of the present invention has alternatively placed his mouth to a small hole typically formed in the center of the underside surface of the foam insulator, and has blown air directly into and through the small hole to assist in expelling the container from the insulating device. This methodology, however, is inefficient, difficult and rather awkward. Moreover, it is not sanitary, especially given that the bottoms of such insulating devices are typically rested on surfaces that are not always clean.

Accordingly, there is a continuing need to create an improved beverage container holder assembly that overcomes deficiencies associated with prior insulator designs. It therefore is an object of the present invention to provide an assembly for a beverage container holder that facilitates removal of the beverage container from the holder in a convenient, efficient, sanitary, and perhaps entertaining, manner. Other objects of the present invention will be apparent to those of ordinary skill in the art from the drawing and the following description.

SUMMARY OF THE INVENTION

The beverage container holder assembly of the present invention facilitates removal of the beverage container from the holder, especially after the contents of the beverage container have been emptied. A preferred embodiment of the invention includes an insulating sleeve that is adapted to retain a beverage container in an interior cavity formed by the sleeve. The sleeve has an open top end to receive the beverage container. The sleeve also has a bottom end that is at least partially open, thereby allowing air to pass between the interior cavity of the sleeve and the exterior of the sleeve through the bottom end of the sleeve. After the contents of the beverage container have been emptied, a pressurizing means may be employed to deliver air pressure into the interior cavity of the sleeve. The air pressure delivered into the interior cavity of the sleeve by way of the pressurizing means generates forces within the interior cavity of the sleeve which operate to facilitate removal of the emptied beverage container from the sleeve through the open top end of the sleeve in a convenient, efficient, sanitary, and perhaps entertaining, manner.

Further advantages and features of the present invention will be apparent to those of ordinary skill in the art in view of the drawing and the detailed description which follows.

BRIEF DESCRIPTION OF THE DRAWING

Preferred embodiments of the present invention are described herein with reference to the drawing wherein:

FIG. 7*a* shows a side view of another embodiment of the present invention, and FIG. 7*b* is a bottom view of the embodiment shown in FIG. 7*a;*

FIG. 8 is a cross-sectional side view of the arrangement shown in FIG. 7*a*; and FIG. 9(*a*) shows a top perspective view of a prior art beverage container holder, and FIG. 9(*b*) shows a bottom perspective view of the prior art beverage container holder shown in FIG. 9(*a*).

DESCRIPTION OF THE PREFERRED EMBODIMENT

Figure 1:
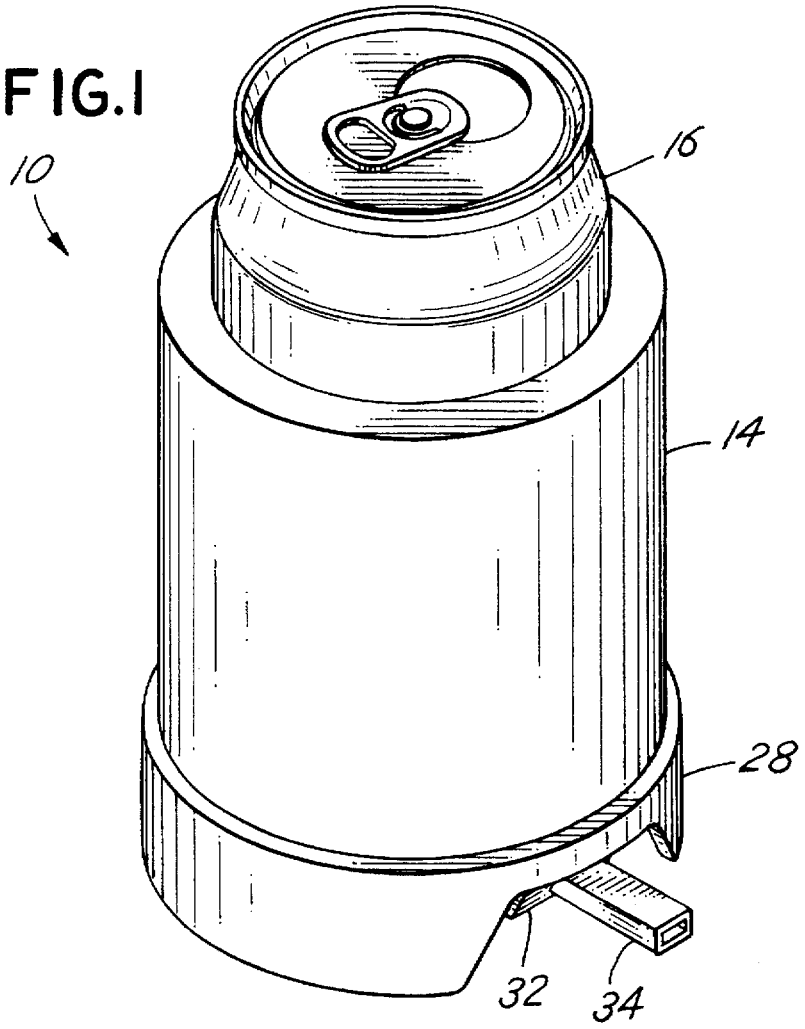
FIG. 1 is a top front perspective view of a holder for a beverage container in accordance with one embodiment of the present invention.
Figure 2:
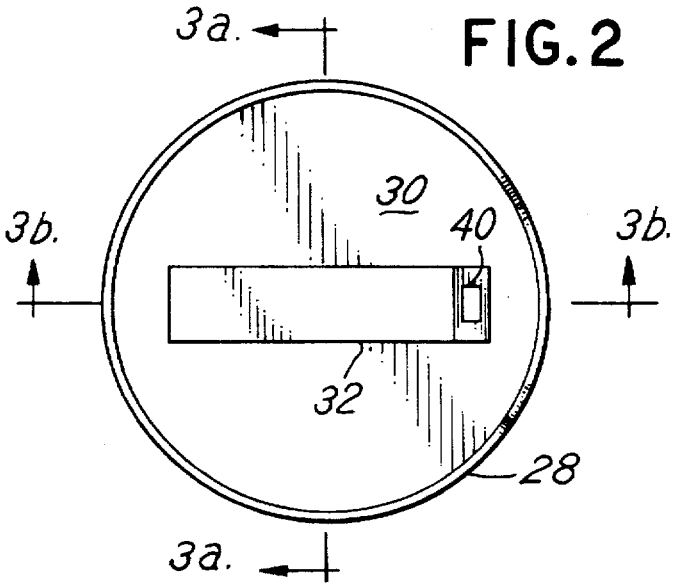
FIG. 2 is a bottom view of the beverage container holder shown in FIG. 1, without an extension member disposed at the bottom of the holder.
Figure 3A:
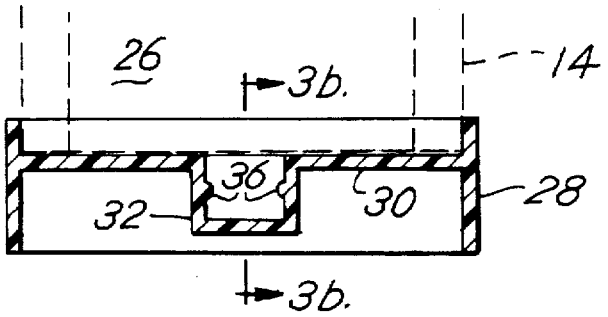
FIG. 3(*a*) and 3(*b*) show two different side views of the lower portion of the beverage container holder shown in FIG. 2.
Figure 3B:
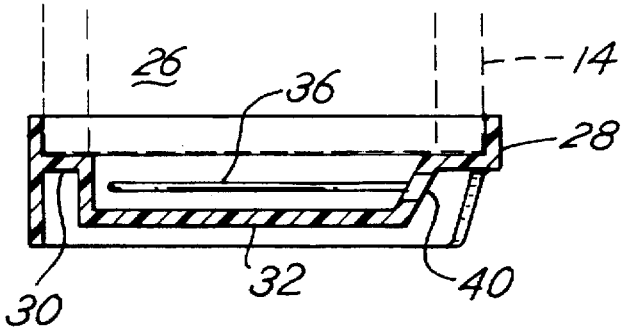
Figure 4A:
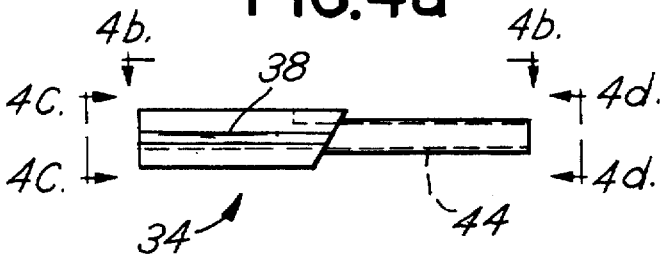
FIG. 4(*a*) shows an elevational view of the side of an extension member used in connection with the beverage container holder shown in FIG. 1, FIG. 4(*b*) shows a top view of the extension member, FIG. 4(*c*) shows an elevational view of a first end of the extension member, and FIG. 4(*d*) shows an elevational view of a second end of the extension member.
Figure 4B:
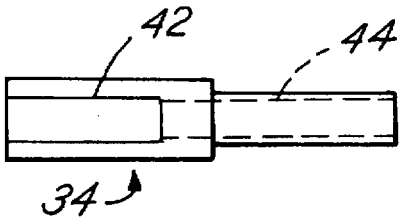
Figure 4D:
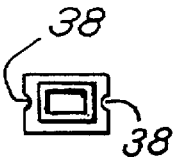
Figure 4C:
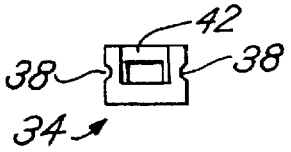

Preferred embodiments of the present invention are shown in FIGS. 1–8. The preferred beverage container holder assembly is realized through a pressurizing means which cooperates with an insulating sleeve that receives and retains a beverage container.

Prior art insulating devices 18 are shown for example in FIGS. 9(*a*) and 9(*b*). Devices of this sort are generally constructed from a soft, flexible but resilient, elastomeric foam insulating material, and are shaped in a cylindrical fashion having dimensions sufficient to receive and retain a standard beverage container, such as a bottle or aluminum can. A circular disk portion 20 formed from the same flexible, foam insulating material is secured within the cylinder 22 at a bottom end to form a bottom resting surface for the insulating device 18. Typically a small aperture 24 is formed in the circular disk 20, as shown for example in FIG. 9(*b*), to allow air to pass between the interior of the insulating device and the exterior of the insulating device. The ability for air to travel between the interior and exterior of the device in this fashion assists in maintaining an equilibrium in air pressure between the interior and exterior of the insulating device, thereby making insertion and removal of a beverage container somewhat easier than it would otherwise be.

The preferred assembly of the present invention includes an insulating sleeve 14 that is constructed from a foam insulating material that is like the materials used to construct prior art devices like that shown for example in FIGS. 9(*a*) and 9(*b*) and described above. The insulating sleeve 14 is formed in a generally cylindrical shape. The interior cavity 26 formed by the insulating sleeve 14 has dimensions that allow a standard beverage container to be received into and retained within the cavity 26. The top end of the sleeve 14 is open to receive the beverage container 16. The bottom end of the sleeve 14 is preferably at least partially open to allow air to pass between the interior cavity 26 of the sleeve 14 and the exterior through the bottom end of the sleeve 14.

Referring now to FIGS. 1–5, the beverage container holder assembly shown in these figures includes a pressurizing means disposed at the bottom portion of the assembly. The various components shown in these figures are constructed from a polymer material that is injection molded. Specifically, shown in the figures is a cylindrical wall 28 which provides support for the entire assembly when the bottom of the cylindrical wall 28 is placed upon a surface. A horizontal surface 30 is disposed within the cylindrical wall 28 to add rigidity and to form a support for the insulating sleeve 14, as well as the container 16. The bottom surface of the beverage container 16 may rest upon the horizontal surface 30 when retained within the interior cavity 26. Alternatively, for example, the bottom end of the sleeve 14 may be at least partially closed with elastomeric foam material to define a bottom edge of said interior cavity 26 upon which the bottom surface of the beverage container 16 may rest when retained within the interior cavity 26. The insulating sleeve 14 may be secured to the horizontal surface 30 and/or the upper portion of the cylindrical wall 28 through the use of adhesives or the like.

Extending from the central portion of the horizontal surface 30 is a guide 32 that is closed on a first end and open on a second end to slidably receive the extension member 34 shown in FIG. 4. Each of the interior sides of the guide 32 include a horizontal rail 36 that is adapted to cooperate with a corresponding horizontal recess 38 formed in the extension member 34 to provide stability and guidance as the extension member 34 is selectively moved between a retracted position, as is shown for example in FIG. 5(*a*), and an extended position, as is shown for example in FIG. 5(*b*). The narrower end of the extension member 34 is preferably sized to fit snugly through aperture 40 in guide 32, such that the wider end of the extension member 34 does not fit through the aperture 40 and remains retained within said guide 32 when the extension member 34 is in an extended position. In this way the extension member 34 may be at least partially locked into said guide 32. Further, the extension member 34 and guide 32 are preferably constructed as shown in the figures such that the air pressure introduced by the consumer generates forces that apply against the extension member 34 from within the guide 32 to create a sealing relationship between the extension member 34 and the guide 32 at the location of the guide aperture 40.

Figure 5A:
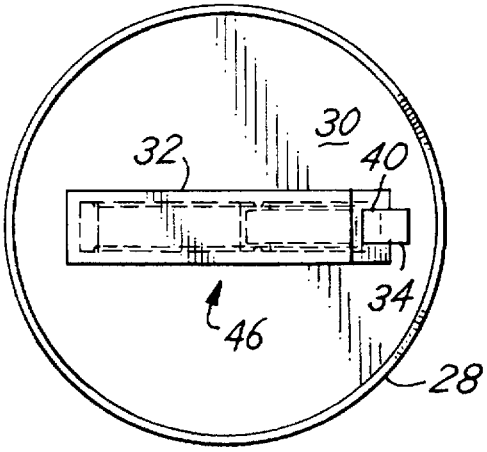
FIG. 5(*a*) shows a bottom view of the beverage container holder shown in FIG. 1 with an extension member in a retracted position, and FIG. 5(*b*) shows a bottom view of the beverage container holder shown in FIG. 1 with an extension member in an extended position.
Figure 5B:
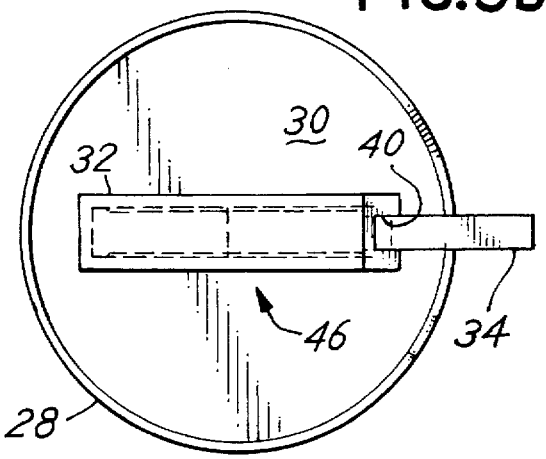

At least a portion of the cylindrical wall 28 is preferably recessed to provide finger access to the retracted extension member 34, so that the consumer may use his or her fingers to reach the end of the extension member 34 and withdraw it to an extended position, as is shown for example in FIGS. 1 and 5(*b*). Moreover, the bottom portion of the cylindrical wall 28 preferably extends downward beyond the bottom surface of the guide 32 to ensure that both the guide 32 and the extension member 34 do not routinely contact the surface upon which the entire assembly may be rested.

The guide 32 is open on its top side to provide fluid (i.e., air) communication between the interior of the guide 32 and the interior cavity 26 of the insulating sleeve 14 through the open bottom end of the insulating sleeve 14. The extension member 34 also has an opening 42 on its top side to provide fluid communication between the interior cavity 26 of the insulating sleeve 14 and an interior passageway 44 that runs along the length of the extension member 34, at least when the extension member 34 is in its extended position. Accordingly, the alignment of the opening 42 on the top side of the extended extension member 34 and the open bottom end of the insulating sleeve 14 allow air to pass from the exterior of the assembly, through an open end of the extension member 34 and into the interior passageway 44, through the open bottom end of the insulating sleeve 14, and into the interior cavity 26 of the insulating sleeve 14.

The extension member 34 is preferably installed into the guide 32 through the open top side of the guide 32. The side walls of the guide 32 are relatively rigid, but flexible enough to accommodate the installation of the extension member 34 into the guide 32.

The extension member 34 is ordinarily stored within the guide 32 in a retracted position, as is shown for example in FIG. 5(*a*). Once the beverage container 16 is empty, the consumer may then withdraw the extension member 34 from the guide 32 to an extended position, as is shown for example in FIG. 5(*b*). The consumer may then place the free end of the extension member 34 to his or her mouth, and blow air through the extension member 34 and into the interior cavity 26 of the insulating sleeve 14. The air thus introduced by the consumer into the interior cavity 26 facilitates removal of the beverage container 16 from the sleeve 14 through the open top end of the sleeve 14. Once removal of the beverage container 16 is complete, the extension member 34 may be returned to its retracted storage position within the guide 32. In this way the guide 32 and the extension member 34 cooperate to form a channel member 46 that may be used to facilitate removal of the beverage container 16.

Figure 6A:
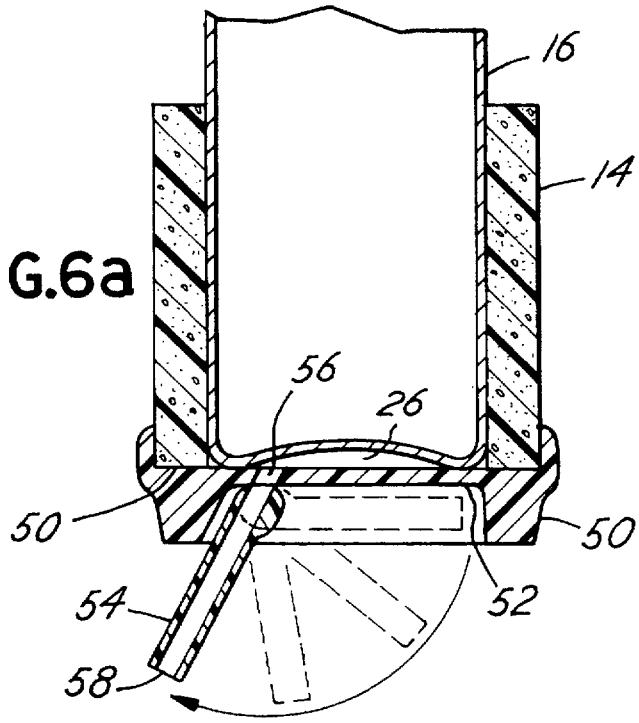
FIG. 6*a* shows a second embodiment of the present invention, having a channel member in an extended position.
Figure 6B:
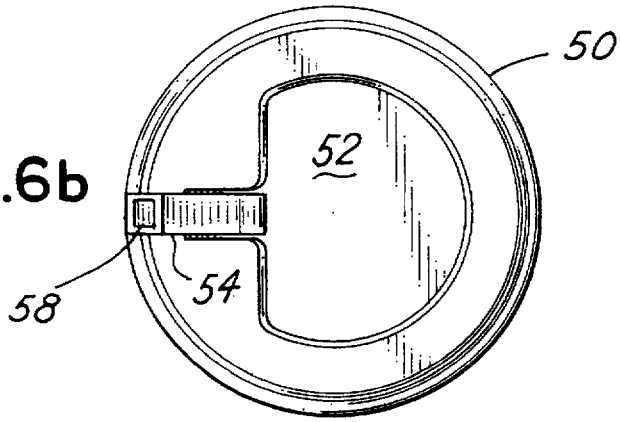
FIG. 6*b* is a bottom view of the embodiment shown in FIG. 6*a;*

Referring now to FIGS. 6*a* and 6*b*, the disclosed beverage container holder assembly includes a pressurizing means disposed at the bottom portion of the assembly. A cylindrical wall 50 provides support for the entire assembly when the bottom of the cylindrical wall 50 is placed upon a surface. A horizontal surface 52 is disposed within the cylindrical wall 50 to add rigidity and to form a support for the insulating sleeve 14, as well as the container 16. The insulating sleeve 14 may be secured to the horizontal surface 52 and/or the upper portion of the cylindrical wall 50 through the use of adhesives or the like.

A recess is formed within the cylindrical wall 50 to receive a channel member 54 that is hingedly connected to the cylindrical wall 50 to allow the channel member 54 to be moved between a retracted storage position and an extended use position, as is shown for example in FIGS. 6*a* and 6*b*. The recess is preferably large enough to allow the consumer to grasp his or her fingers along the girth of the channel member 54 for the purpose of moving the channel member 54 to an extended use position. Further, the retracted storage position of the channel member 54 itself is preferably at least slightly recessed from the bottom surface of the cylindrical wall 50 to help keep the channel member 54 clean when not in use (i.e., the channel member 54 does not come into direct contact with potentially dirty surfaces upon which the entire assembly may be rested).

When positioned in its extended use position, the channel member 54 aligns with aperture 56 and the open bottom end of the insulating sleeve 14 to allow air pressure to be communicated through the interior passageway 58 of the channel member 54, through the aperture 56, and into the interior cavity 26 of the insulating sleeve 14. After the beverage container 16 has been emptied, the consumer may move the channel member 54 to an extended position, as is shown for example in FIGS. 6*a* and 6*b*. The consumer may then place the free end of the channel member 54 to his or her mouth, and blow air through the channel member 54 and into the interior cavity 26 of the insulating sleeve 14. Again, the air thus introduced by the consumer into the interior cavity 26 facilitates removal of the beverage container 16 from the sleeve 14 through the open top end of the sleeve 14. Once removal of the beverage container 16 is complete, the channel member 54 may be returned to its retracted storage position.

Another embodiment of the present invention is shown for example in FIGS. 7*a*, 7*b* and 8. The disclosed beverage container holder assembly includes a pressurizing means disposed at the bottom portion of the assembly. A compressible element 62 is formed using a polymeric material that is blow molded to have a hollowed and generally cylindrical shape. The side wall 64 of the compressible element has a corrugation that is collapsible to generate air pressure within the compressible element 62. The consumer may selectively collapse the compressible element 62 by positioning the bottom of the compressible element 62 against a firm surface and grasping the top portion of the compressible element 62 to exert a collapsing force in the direction of the firm surface. The generated air pressure is thereby substantially communicated through the open bottom end of the sleeve 14 and into the interior cavity 26 of the sleeve 14. Thus, the compressible element 62 is preferably closed at a bottom end 68, with the exception of a small aperture 70 that allows air to pass to assist in the recovery of the compressible element 62 from a compressed state.

The compressible element 62 may be either affixed to the insulating sleeve 14 to form a single improved beverage container holder, or it may stand independent of the insulating sleeve 14 to allow multiple consumers to individually place their respective insulating sleeves on the compressible element 62 to facilitate removal of their individual beverage containers. If the compressible element 62 is affixed to the insulating sleeve 14 to form a single improved beverage container holder, the compressible element 62 is preferably flat-bottomed and sufficiently rigid to provide support for the entire assembly when the bottom of the assembly is placed upon a surface.

Although certain embodiments of the invention have been described and illustrated herein, it will be readily apparent to those of ordinary skill in the art that a number of modifications and substitutions can be made to the improved beverage container holder assembly disclosed and described herein without departing from the true spirit and scope of the invention.

We claim:

1. An improved holder for a beverage container that facilitates removal of said beverage container from the holder, including an insulating sleeve adapted to retain said beverage container in an interior cavity formed by said sleeve, said sleeve having an open top end to receive said beverage container and a bottom end that is at least partially open, wherein the improvement comprises:

pressurizing means for delivering air from outside said sleeve through said open bottom end of said sleeve and into said interior cavity of said sleeve, thereby facilitating removal of said beverage container from said sleeve through said open top end wherein said pressurizing means comprises an air channel member having an interior passageway that is open on a first end and communicates on a second end with said opening in said bottom end of said sleeve, whereby air pressure introduced into said first end of said air channel member is communicated through said interior passageway to said interior cavity of said sleeve, wherein said air channel member is movable between a retracted storage position and an extended use position, said holder having an outer perimeter, wherein said air channel member is located totally within said outer perimeter when in the retracted position and extends to the outside of said outer perimeter when in the extended use position.

2. An improved holder for a beverage container that facilitates removal of said beverage container from the holder, including an insulating sleeve adapted to retain said beverage container in an interior cavity formed by said sleeve, said sleeve having an open top end to receive said beverage container and a bottom end that is at least partially open, wherein the improvement comprises:

pressurizing means for delivering air from outside said sleeve through said open bottom end of said sleeve into said interior cavity of said sleeve, thereby facilitating removal of said beverage container from said sleeve through said open top end, wherein said pressurizing means comprises a compressible element, separated from said sleeve, having a corrugated side wall that is collapsible to generate air pressure within said compressible element, designed to cooperate with said sleeve to communicate said air pressure through said bottom end of said sleeve to said interior cavity of said sleeve, said compressible element attached to and extending below said bottom end of said sleeve.

3. A holder for a beverage container that facilitates removal of said beverage container from the holder, comprising:

an insulated sleeve adapted to retain said beverage container in an interior cavity formed by said sleeve, said sleeve having an open top end to receive said beverage container and a bottom end that is at least partially open;

an air channel member having an interior passageway that is open on a first end and communicates on a second end with said opening in said bottom end of said sleeve, whereby air pressure introduced into said first end of said air channel member is communicated through said interior passageway to said interior cavity of said sleeve to facilitate removal of said beverage container from said sleeve through said open top end, wherein said air channel member is movable between a retracted storage position and an extended use position, said holder having an outer perimeter, wherein said air channel member is located totally within said outer perimeter when in the retracted position and extends to the outside of said outer perimeter when in the extended use position.

4. A holder for a beverage container that facilitates removal of said beverage container from the holder, comprising:

an insulated sleeve adapted to retain said beverage container in an interior cavity formed by said sleeve, said sleeve having an open top end to receive said beverage container and a bottom end that is at least partially open;

a compressible element, separated from said sleeve, having a corrugated side wall that is collapsible to generate air pressure within said compressible element, designed to cooperate with said sleeve to communicate said air pressure from outside said sleeve through said bottom end of said sleeve to said interior cavity of said sleeve, whereby said air pressure introduced into said interior cavity of said sleeve facilitates removal of said beverage container from said sleeve through said open top end, said compressible element attached to and extending below said bottom end of said sleeve.

* * * * *